US005816433A

United States Patent [19]

Higgins

[11] Patent Number: 5,816,433

[45] Date of Patent: Oct. 6, 1998

[54] PORTABLE COOLER

[76] Inventor: Stephen M. Higgins, 444 S. 4th, Colwich, Kans. 67030

[21] Appl. No.: 886,902

[22] Filed: Jul. 2, 1997

[51] Int. Cl.[6] ..... B65D 81/00

[52] U.S. Cl. ..... 220/534; 220/503

[58] Field of Search ..... 220/534, 503, 220/527, 528

[56] References Cited

U.S. PATENT DOCUMENTS

| | | | |
|---|---|---|---|
| 1,042,249 | 10/1912 | Mickelson . | |
| 3,395,550 | 8/1968 | Dungan . | |
| 3,572,054 | 3/1971 | Curcio . | |
| 4,128,170 | 12/1978 | Elliott | 220/503 X |
| 4,577,475 | 3/1986 | Herrera . | |
| 4,648,512 | 3/1987 | Tarozzi et al. . | |
| 4,893,722 | 1/1990 | Jones | 220/503 |
| 4,899,904 | 2/1990 | Dooley et al. . | |
| 4,988,010 | 1/1991 | Pollak | 220/503 |
| 5,129,543 | 7/1992 | White . | |
| 5,263,338 | 11/1993 | Banks . | |
| 5,325,969 | 7/1994 | Gordon et al. . | |

*Primary Examiner*—Steven M. Polland
*Attorney, Agent, or Firm*—Shook, Hardy & Bacon L.L.P.

[57] ABSTRACT

A portable cooler 10 includes an insulated body 12 presenting an interior space and an open top, and an insulated cover 14 for closing off the body. A storage compartment 16 extends through an opening 26 in the side wall 20 of the body into the interior space, and includes top, bottom and side walls 28, 30, 32 that are spaced from the bottom and side walls 18, 20 of the body and exposed to the interior space to define a dry cell within the storage compartment. An insulated compartment cover 36 closes off the opening in the side wall of the body and is movable relative to the body to provide access to the dry cell so that articles to be stored in the cooler can be isolated from the ice and water that is retained in the interior space of the cooler body.

22 Claims, 2 Drawing Sheets

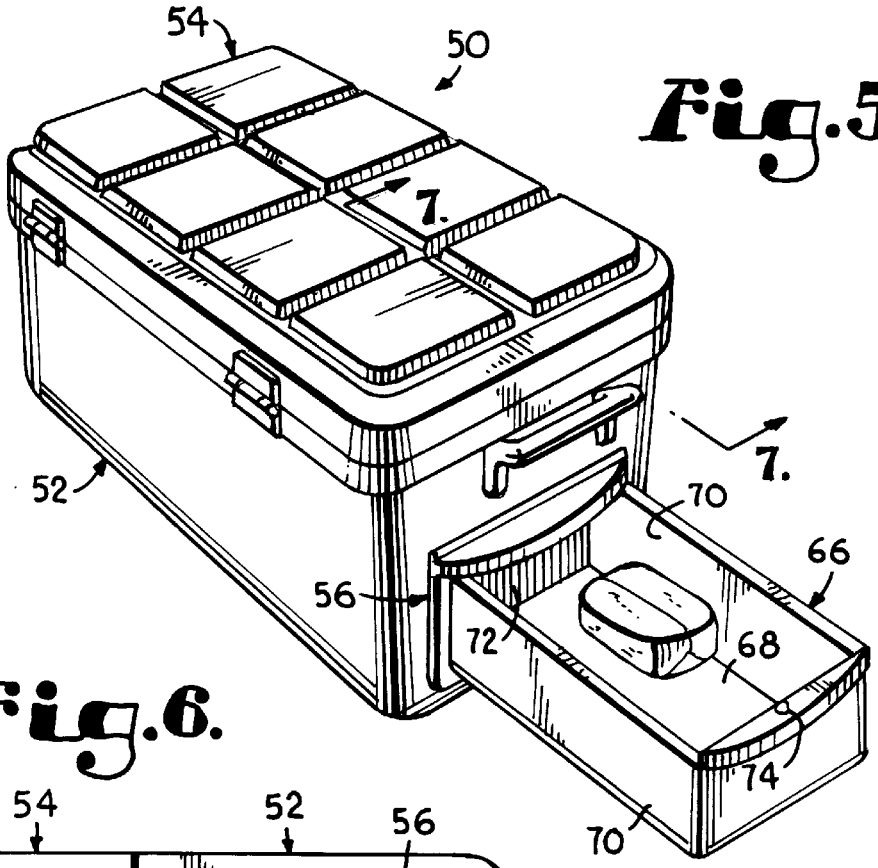
Fig.5.
Fig.6.
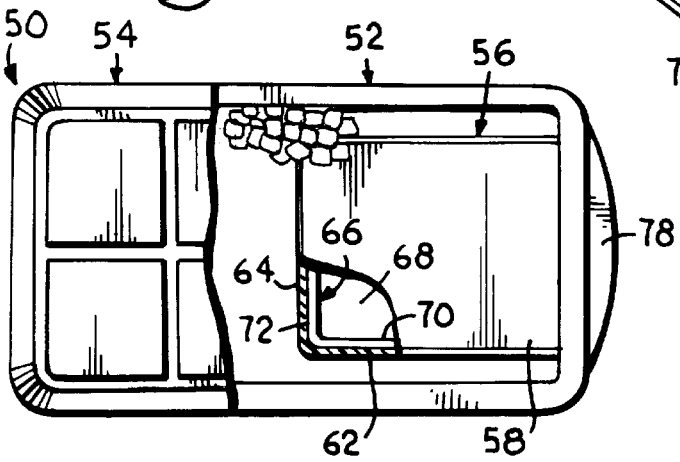
Fig.7.
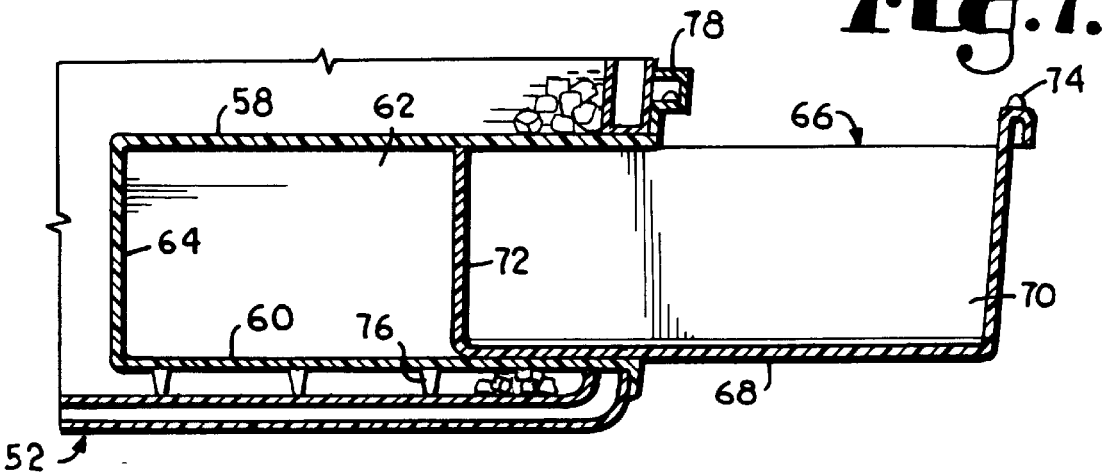

PORTABLE COOLER

BACKGROUND OF THE INVENTION

The present invention relates generally to storage containers, and more particularly to a portable cooler having one or more externally accessible compartments presenting dry storage cells that are isolated from, but in thermal contact with, the interior of the cooler.

It is known to provide a portable cooler having an insulated body presenting an open interior space in which ice and one or more articles to be cooled are stored. Typically, a hinged cover, also formed of insulative material, is provided on the cooler for closing the interior space in order to maintain the temperature of the articles in the cooler. Handles are usually secured to or formed in the cooler for facilitating transportation thereof, and a drain may be fitted in the body for draining water and other liquids from the cooler without opening the cover.

Several problems arise in the use of this conventional cooler construction. For example, because the cooler is portable, it is also easily upended, causing the ice, water and other articles such as food and beverages stored in the interior space to be spilled and possibly ruined prior to serving their usefulness. Also, because ice and food articles are all commonly resident in the same space, the food articles tend to get soggy and saturated as the ice melts and begins to be replaced by water. Although trays can be used to support food articles above the ice and water in the cooler, the air space adjacent the cover is inappropriate for the storage of many types of perishables since the temperature of the air space is substantially higher than that of the ice and water in the bottom of the cooler. As such, articles stored in these types of trays spoil rapidly.

Another problem that arises in the use of the conventional cooler construction is that of repeated opening and closing of the cover each time a food or beverage article is retrieved from the cooler. With each opening of the cover, heat is allowed into the interior space, warming the space and reducing the useful life of the ice or other cooling medium. In addition, the free space within the cooler above the ice must be recooled after each opening of the cover, resulting in an air temperature within the cooler that is too high to prevent many foods from spoiling. As such, it is not appropriate to use the conventional construction to store certain types of perishable articles.

A proposed solution in the prior art to the foregoing drawbacks of conventional coolers includes providing a such a cooler with an opening in one of the side walls thereof within which a storage device is received. The prior art storage device includes an enclosure within which articles may be stored, and a cover for closing the enclosure. In this known construction, the bottom wall of the cooler is modified to include a raised section, and the enclosure is supported beneath the bottom wall within the raised section so that articles in the enclosure can be retrieved without opening the cooler.

By providing the prior art construction, the enclosure is cooled by ice and water in the interior space of the cooler that contacts the bottom wall of the cooler and surrounds the side and top walls of the enclosure. However, because heat must be transferred through both the walls of the enclosure and the bottom wall of the cooler body, it takes a long time to recool the enclosure after each opening thereof. In addition, no heat is transferred from the bottom wall of the enclosure, further impeding the cooling ability of the cooler.

SUMMARY OF THE INVENTION

It is an object of the present invention to provide a portable cooler that addresses the noted problems experienced in the use of conventional coolers by presenting one or more externally accessible storage compartments that allow articles to be cooled in a dry cell isolated from the ice or other cooling medium stored in the interior space of the cooler.

In addition, it is an object of the invention to construct such a cooler with each dry cell being completely engulfed by the interior space of the cooler so that heat is transferred through the bottom, top and side walls of the compartment, facilitating heat transfer between the cell and the surrounding space of the cooler.

Another object of the invention is to provide a portable cooler in which at least one dry cell is removable from the cooler and includes a double-walled construction containing a heat transfer medium such that the cell can be frozen prior to use in the cooler.

In accordance with these and other objects evident from the following description of a preferred embodiment of the invention, a portable cooler is provided that includes an insulated, open-topped body having bottom and side walls and an opening extending through the side wall. An insulated top cover closes off the top of the body, and is movable relative to the body to provide access to the interior space, permitting ice and other articles to be placed in the space. A storage compartment extends through the opening in the side wall of the body into the interior space, and includes top, bottom and side walls that are spaced from the bottom and side walls of the body and exposed to the interior space to define a water-tight cell within the storage compartment. The compartment includes an insulated door or cover that closes off the opening in the side wall of the body while allowing access to the dry cell so that articles may be placed into the cell for cooling without requiring opening of the top cover of the cooler.

By providing an apparatus in accordance with the present invention, numerous advantages are realized. For example, by spacing the storage compartment from the bottom and side walls of the cooler base, the dry cell defined by the compartment is engulfed by the interior space of the cooler, providing heat transfer through the top, bottom and side walls of the compartment. This construction permits the dry cell to be surrounded by ice and water in the bottom of the cooler so that the contents thereof are cooled more quickly and to a substantially lower temperature than would be the case if the contents were placed in the free space within the interior of the cooler body. In addition, by isolating the dry cell from the interior space, it remains dry, preserving food and other articles without soaking or saturating them as is the case when such items are placed directly in the cooler.

BRIEF DESCRIPTION OF THE DRAWING

The preferred embodiment of the present invention is described in detail below with reference to the attached drawing figures, wherein:

FIG. 5 is a perspective view of a second portable cooler constructed in accordance with the preferred embodiment;

FIG. 6 is a top plan view of the second cooler, partially cut away to illustrate a pair of compartments forming a part thereof;

FIG. 7 is a sectional view of the second cooler taken along line 7—7 of FIG. 5.

DETAILED DESCRIPTION OF THE PREFERRED EMBODIMENT

Figure 1:
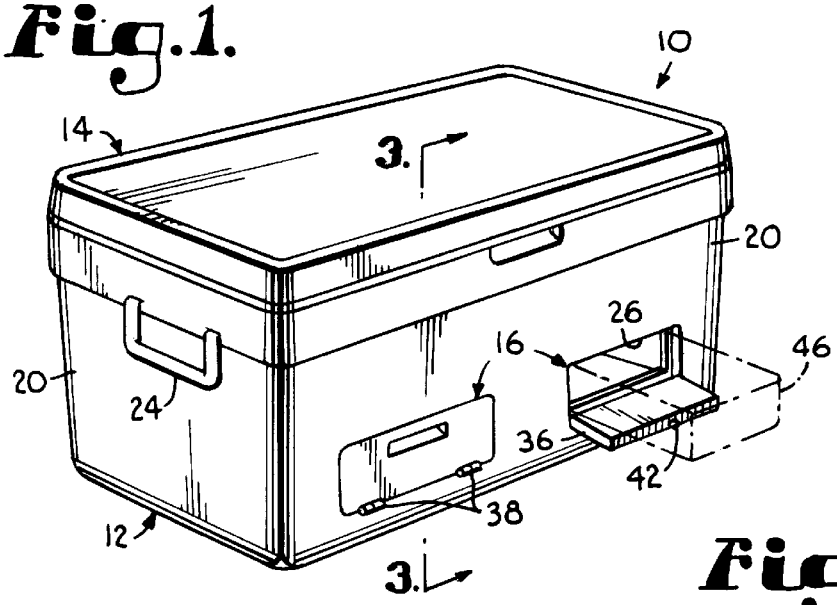
FIG. 1 is a perspective view of a first portable cooler constructed in accordance with the preferred embodiment.
Figure 2:
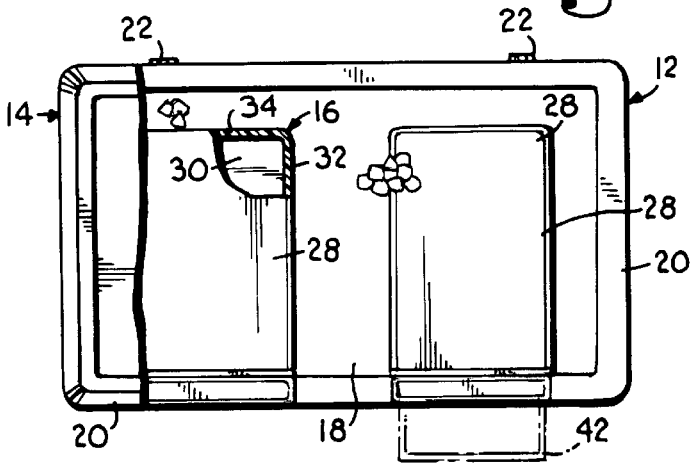
FIG. 2 is a top plan view of the first cooler, partially cut away to illustrate a pair of compartments forming a part of the cooler.

A first portable cooler 10 constructed in accordance with the preferred embodiment is illustrated in FIG. 1, and broadly includes an insulated body 12 and an insulated cover 14 hingedly connected to the body for movement between a closed position in sealing engagement with the body and an open position exposing an interior space of the body. In addition, as shown in FIG. 2, the cooler also includes a pair of side-by-side storage compartments 16 extending into the body.

Figure 3:
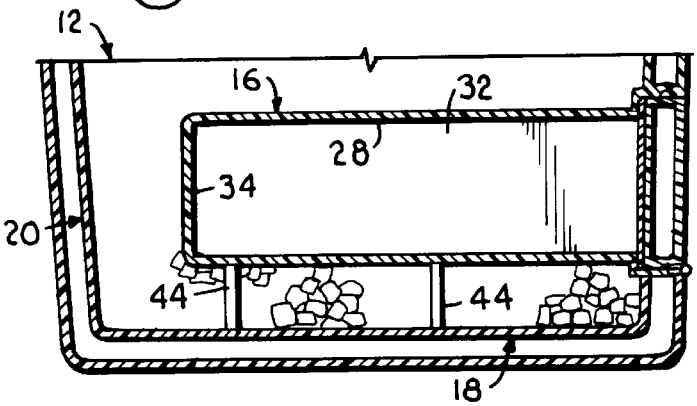
FIG. 3 is a sectional view of the first cooler taken along line 3—3 of FIG. 1.

The body 12 includes a bottom wall 18, shown in FIG. 3, and four upstanding side walls 20, and is either formed of an insulative material such as foamed polystyrene or the like, or includes a double-walled construction that insulates the interior space of the body from thermal gradients existing across the bottom and side walls thereof. The illustrated embodiment includes a double-walled construction, and is preferably formed of a suitable synthetic resin material such as polypropylene using a rotation molding technique. As such, the walls 18, 20 all include one or more dead air spaces therein that insulate the interior space of the body from thermal conditions ambient to the cooler.

The top cover 14 of the preferred embodiment is also of double-walled construction, presenting an inner surface that mates with the side walls of the body to seal the interior space of the body shut when placed in the closed position. As shown in FIG. 2, the cover is connected to the body by a pair of hinges 22 that permit opening and closing of the cover, but could also be freely removable from the body, if desired. Returning to FIG. 1, handles 24 are secured to opposing side walls of the body to facilitate transportation of the cooler, and a drain can be provided in the bottom wall or at the bottom of one of the side walls for permitting draining of the interior space.

One of the side walls of the body 12 is formed with a pair of side-by-side openings 26 that extend through the side wall into the interior space of the body, and a storage compartment is provided in each opening. Although two openings are shown in the illustrated embodiment, a fewer or greater number can be employed, and such openings can extend through any or all of the side walls 20, with storage compartments provided in each. The storage compartments are substantially identical to one another and bear the same reference numerals as used herein to describe a single compartment.

As shown in FIG. 2, each compartment 16 broadly includes a top wall 28, a bottom wall 30, opposed lateral side walls 32, and an end wall 34, all of which together define a small enclosed cavity or space referred to herein as a cell. The front side of the compartment facing the opening 26 in the side wall 20 is open, exposing the cell to the opening so that articles to be cooled may be placed in and removed from the cell. As shown in FIG. 3, an insulated door or cover 36 is provided over the opening in the side wall, and is movable between a closed position in sealing engagement with the side wall of the body and an open position exposing the cell.

The bottom, side and end walls 30, 32, 34 of the compartment 16 are spaced from the bottom and side walls 18, 20 of the body by a distance great enough to accommodate receipt of ice or any other cooling medium therebetween. As such, all of the walls of the compartment are exposed to the interior space and heat is transferred both upward and downward between the cell and the interior space of the body, as well as to both sides and out the end wall 34. In addition, the walls of the compartment are unitary or otherwise sealed together to be water-tight so that water and moisture within the interior space of the cooler is prohibited from contacting items in the cell. Thus, the cell is a "dry" cell in that it is physically isolated from the interior space of the body, and permits food and other items to be cooled in a dry environment within the cooler that is accessible even when the top cover of the cooler remains closed.

Figure 4:
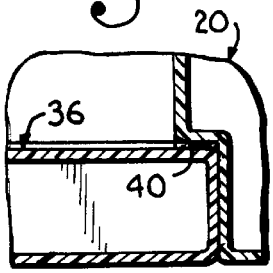
FIG. 4 is a fragmentary sectional view of a cover forming a part of one of the compartments.

As with the side walls 20 of the body 12, the cover 36 is double-walled, and is secured to the side wall by hinges 38 that permit the cover to be pivoted between the open and closed positions. The cover 36 is preferably formed of the same material as the walls of the body, and can be sized either to fit within the opening flush with the side wall, as shown, or to protrude from the side wall in covering relation to the opening. Preferably, as shown in FIG. 4, a resilient rubber gasket 40 or the like is adhered to the side wall 20 within the opening 26 and is sandwiched between the cover and the side wall in the closed position of the cover to further insulate the cell against heat loss and prevent entry of dirt or debris.

Returning to FIG. 3, in order to lock the cover 36 in the closed position, a detent mechanism is provided which includes a small protrusion 42 formed on an upper edge of the cover, and a small recess formed in the side wall 20 at the top of the opening 26. When the cover is closed, the protrusion 42 is received in the recess, holding the cover in place. In order to open the cover, it must be pulled with sufficient force to dislodge the protrusion from the cavity, freeing the cover for pivoting movement to the open position. Other types of latch mechanisms can be employed in place of the protrusion 42 and the recess in the side wall 20 without departing from the preferred embodiment of the present invention.

Although the walls 28, 30, 32, 34 of the compartment are preferably formed of a synthetic resin material, they may alternately be formed of metal or any other suitable material having good heat transfer characteristics in order to improve the cooling effect provided by the inventive construction. In addition, fins may be provided on any or all of the walls, extending into or out of the dry cell, further facilitating heat transfer between a cooling medium in the interior space of the body and the dry cell. As shown in FIG. 3, a plurality of legs 44 protrude from the bottom wall of the compartment to support the compartment above the bottom wall of the body, and these legs may be shaped as fins to facilitate heat transfer to and from the dry cell.

As shown in broken lines in FIG. 1, it is possible to provide a drawer or container 46 that is sized for receipt in the dry cell. The drawer or container 46 fits in the cell when the cover 36 is closed, and can be pulled from the compartment when the cover is open. As such, access to the cell is facilitated.

Although the legs are illustrated as extending from the bottom wall of the compartment, they could be provided on any or all of the walls of the compartment to support the compartment within the cooler and to facilitate heat transfer between the cooler and the cell. Also, in place of legs, it is possible to employ any other known type of fin configuration or radiator design for each wall to maximize the cooling efficiency of the cooler.

With reference to FIG. 1, during use of the first portable cooler, the top cover 14 is removed and the interior space of the body 12 is filled with ice, water or any other suitable cooling medium. In addition, beverage cans and other items that do not benefit significantly from being stored in a dry cooling environment may be placed in the space as in the use of conventional cooler constructions. Thereafter, the top cover is closed and need not be reopened unless it is necessary to retrieve one of the items placed in the interior space with the cooling medium.

Any items to be stored in the cooler away from the cooling medium are then placed in one of the compartments by opening the cover 36 of the compartment and placing the item inside. Because the cell is dry, there is no concern that the item will become soggy or saturated, or that it will be ruined if the cooler is overturned during transportation. In addition, the temperature in the dry cell is maintained at a temperature that is lower than the free space within the body since heat is transferred through all of the walls of the compartment directly to the ice and water in the bottom of the cooler. As such, the dry cell quickly returns to a cool temperature each time the cover 36 is closed, and because the top cover 14 is not opened and closed each time an item is pulled from the compartments, the cooling medium maintains a substantially lower temperature for an extended time relative to conventional coolers.

A second portable cooler 50 constructed in accordance with the preferred embodiment is shown in FIG. 5, and resembles the cooler 10 in that it is provided with an insulated body 52 and an insulated cover 54 hingedly connected to the body for movement between closed and open positions. However, in the cooler 50, a single storage compartment 56 is provided, and extends through the body at a different location than the compartments in the first cooler.

One of the end walls of the body 52 is formed with a single opening that extends through the wall into the interior space of the body, and the storage compartment is provided in the opening. As shown in FIGS. 6 and 7, the storage compartment 56 broadly includes a top wall 58, a bottom wall 60, opposed lateral side walls 62, and an end wall 64, all of which together define a cell. The front side of the compartment facing the opening in the side wall is open, exposing the cell to the opening so that articles to be cooled may be placed in and removed from the cell. However, unlike the compartments of the first cooler, the compartment 56 is not provided with an insulated door or cover. Instead, a drawer 66 is provided that is sized for receipt in the cell, and the drawer includes an insulated front wall that functions as a cover for the compartment when the drawer is closed.

The drawer is shown in FIG. 7, and includes bottom, side and end walls 68, 70, 72, but is open at the top to permit items to be placed in the drawer when it is pulled from the cell. A lid for the drawer may be provided, but is not required. In order to keep the drawer closed, a detent mechanism is provided which includes a small protrusion 74 formed on an upper edge of the insulated front wall, and a small recess formed in a hood 78 protruding from the end wall or other latching mechanisms. When the drawer is closed, the protrusion is received in the recess, holding the drawer shut. In order to open the drawer, it must be pulled with sufficient force to dislodge the protrusion from the cavity, freeing the drawer for sliding movement. Other types of latch mechanisms can be employed in place of the protrusion 74 and the recess in the hood 78 without departing from the preferred embodiment of the present invention.

The bottom, side and end walls 60, 62, 64 of the compartment are spaced from the bottom and side walls of the body by a distance great enough to accommodate receipt of ice or any other cooling medium therebetween. As such, all of the walls of the compartment are exposed to the interior space and heat is transferred both upward and downward between the cell and the interior space of the body, as well as to both sides and the end wall 64. In addition, the walls of the compartment are unitary or otherwise sealed together to be water-tight so that water and moisture within the interior space of the cooler is prohibited from contacting items in the drawer. A plurality of legs 76 protrude from the bottom wall of the compartment to support the compartment above the bottom wall of the body, and these legs may be shaped as fins to facilitate heat transfer to and from the dry cell.

Although the legs are illustrated as extending from the bottom wall of the compartment, they could be provided on any or all of the walls of the compartment to support the compartment within the cooler and to facilitate heat transfer between the cooler and the cell. Also, in place of legs, it is possible to employ any other known type of fin configuration or radiator design for each wall to maximize the cooling efficiency of the cooler.

The second cooler is used in substantially the same manner as the first cooler. Initially, the top cover 54 is removed and the interior space of the body 52 is filled with ice or the like, and the top cover is closed and need not be reopened unless it is necessary to retrieve an item that has been placed in the interior space with the ice. Any items to be stored in the cooler away from the ice are then placed in the drawer 66 of the compartment 56 and the drawer is closed, insulating the cell against heat gain. There is no concern that the item will become soggy or saturated, or that it will be ruined if the cooler is upturned during transportation. In addition, the temperature in the dry cell is maintained at a temperature that is substantially lower than the free space within the body since heat is transferred through all of the walls of the compartment directly to the ice and water in the bottom of the cooler.

Figure 8:
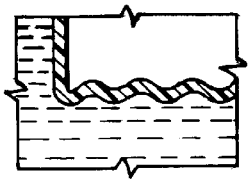
FIG. 8 is a fragmentary elevation view showing an alternate embodiment of a wall of a compartment in the cooler.

Although the present invention has been described with reference to the preferred embodiment, it is noted that equivalents may be employed and substitutions made herein without departing from the scope of the invention as recited in the claims. For example, the compartment could be made removable from the cooler and formed of a double-walled construction, wherein a heat transfer medium is contained between the walls of the compartment. As such, the compartment could be removed from the cooler and frozen prior to use. Also, rather than using fins to transfer heat from the compartment, it is possible to form one or more of the walls of the compartment with a corrugated or ridged configuration such as shown in FIG. 8 to increase the surface area of the compartment exposed to the interior space. As such, the ridges exposed to the cell could serve both as a radiator and as a track for guiding movement of the drawer or container received in the compartment.

What is claimed is:

1. A portable cooler comprising:

an insulated body defining an interior space and including a bottom wall, a side wall, and an opening in the side wall, the bottom and side walls each including an interior surface exposed to the interior space;

a storage compartment extending into the interior space of the insulated body through the opening in the side wall, the storage compartment including top, bottom and side walls that are each spaced from the interior surfaces of the bottom and side walls of the insulated body and exposed to the interior space so that the storage compartment defines a dry cell within the interior space of the insulated body; and a closure means for closing off the opening in the side wall of the body, the closure means being movable relative to the body to provide access to the cell.

2. A portable cooler as recited in claim 1, wherein the body presents an open top and the cooler further comprises an insulated top cover for closing off the open top, the top cover being movable relative to the body to provide access to the interior space.

3. A portable cooler as recited in claim 1, wherein the closure means includes an insulated compartment cover for closing off the opening in the side wall of the body.

4. A portable cooler as recited in claim 1, wherein the closure means includes a drawer sized for receipt in the cell, the drawer including an insulated front wall that closes off the opening in the side wall of the body when the drawer is positioned in the cell.

5. A portable cooler as recited in claim 1, further comprising a drawer that is sized for receipt in the cell.

6. A portable cooler as recited in claim 3, further comprising a drawer that is sized for receipt in the cell.

7. A portable cooler as recited in claim 1, further comprising a plurality of legs extending between at least one of the walls of the compartment and an adjacent wall of the body for supporting the compartment within the interior space.

8. A portable cooler as recited in claim 7, wherein the legs are fins presenting surfaces across which heat is exchanged between the bottom wall of the compartment and the interior space of the body.

9. A portable cooler as recited in claim 1, wherein at least one of the walls of the compartment includes fins presenting surfaces across which heat is exchanged between the walls of the compartment and the interior space of the body.

10. A portable cooler as recited in claim 1, wherein the body defines a plurality of holes in the side wall and a plurality of storage compartments are provided, each storage compartment extending through one of the holes in the side wall into the interior space.

11. A portable cooler as recited in claim 1, wherein the body includes a drain for draining the interior space.

12. A portable cooler as recited in claim 1, further comprising at least one handle for permitting lifting and transportation of the cooler.

13. A portable cooler comprising:

an insulated body defining an interior space and including a bottom wall, a side wall presenting an opening, and an open top, the bottom and side walls each including an interior surface exposed to the interior space;

an insulated top cover for closing off the open top of the body, the top cover being movable relative to the body to provide access to the interior space;

a storage compartment extending into the interior space of the insulated body through the opening in the side wall, the storage compartment including top, bottom and side walls that are each spaced from the bottom and side walls of the insulated body and exposed to the interior space so that the storage compartment defines a dry cell within the interior space of the insulated body; and an insulated compartment cover for closing off the opening in the side wall of the body, the compartment cover being movable relative to the body to provide access to the dry cell.

14. A portable cooler as recited in claim 13, further comprising a drawer sized for receipt in the cell, the insulated compartment cover being mounted on the drawer so that the compartment cover closes off the opening in the side wall of the body when the drawer is positioned in the cell.

15. A portable cooler as recited in claim 13, further comprising a drawer that is sized for receipt in the cell.

16. A portable cooler as recited in claim 13, further comprising a plurality of legs extending between at least one of the walls of the compartment and an adjacent wall of the body for supporting the compartment within the interior space.

17. A portable cooler as recited in claim 16, wherein the legs are fins presenting surfaces across which heat is exchanged between the bottom wall of the compartment and the interior space of the body.

18. A portable cooler as recited in claim 13, wherein at least one of the walls of the compartment includes fins presenting surfaces across which heat is exchanged between the walls of the compartment and the interior space of the body.

19. A portable cooler as recited in claim 13, wherein the body defines a plurality of holes in the side wall and a plurality of storage compartments are provided, each storage compartment extending through one of the holes in the side wall into the interior space.

20. A portable cooler as recited in claim 13, wherein the body includes a drain for draining the interior space.

21. A portable cooler as recited in claim 13, further comprising at least one handle for permitting lifting and transportation of the cooler.

22. A portable cooler as recited in claim 13, wherein the storage compartment includes an inner end wall opposite the opening in the side wall of the body, the end wall being spaced from the bottom and side walls of the body and exposed to the interior space.

* * * * *